XR 4,171,002

United Sta

Smith

[11] 4,171,002

[45] Oct. 16, 1979

[54] NUCLEAR FUEL TRANSPORTATION CONTAINERS

[75] Inventor: Alfred J. Smith, Stockport, England

[73] Assignee: British Nuclear Fuels Ltd., Risley, England

[21] Appl. No.: 844,036

[22] Filed: Oct. 20, 1977

[51] Int. Cl.[2] ..... B08B 3/02; B08B 9/08

[52] U.S. Cl. ..... 134/166 R; 250/506

[58] Field of Search ..... 250/506, 507; 134/166 R, 169 R, 170, 171

[56] References Cited

U.S. PATENT DOCUMENTS

| | | | |
|---|---|---|---|
| 3,229,096 | 1/1966 | Bonilla et al. | 250/507 |
| 3,250,118 | 5/1966 | Johnson, Jr. | 134/166 R X |
| 3,623,910 | 11/1971 | Calhoun et al. | 134/166 R X |
| 3,823,065 | 7/1974 | Jones | 250/506 X |

FOREIGN PATENT DOCUMENTS

| | | | |
|---|---|---|---|
| 1378681 | 12/1974 | United Kingdom | 250/507 |

*Primary Examiner*—Robert L. Bleutge
*Attorney, Agent, or Firm*—Larson, Taylor and Hinds

[57] ABSTRACT

An inner container for a nuclear fuel transportation flask for irradiated fuel elements comprising a cylindrical shell having a dished end closure with a drainage sump and means for flushing out solid matter by way of the sump prior to removing a cover.

4 Claims, 2 Drawing Figures

NUCLEAR FUEL TRANSPORTATION CONTAINERS

BACKGROUND OF THE INVENTION

This invention relates to the transportation of fuel elements which have been irradiated in a nuclear reactor. In the present context a nuclear reactor fuel element is to be understood to include not only the type of element whose content of fissile material is such that under irradiation in the reactor the primary purpose is the generation of power brought about by fission but also the type of element which is commonly known as a breeder element, one whose content of fertile material is such that under irradiation in the reactor the primary purpose is the conversion of fertile material into fissile material.

Transportation is necessary for the conveyance of the fuel element from the nuclear reactor in which it has been irradiated to a reprocessing or storage facility, the usual objective being to subject the element after appropriate storage and dismantling steps to a reprocessing operation by which certain re-usable components, particularly fissile components, are recovered. Subsequent to irradiation the fuel element is not only radioactive but also continues to generate heat on account of the radioactive decay of fission products. The requirement for safe transportation therefore calls for comprehensive and expensive equipment.

It is generally the case at the present time that an irradiated fuel transport container consists basically of two main parts, a flask on the one hand and an inner container or bottle on the other hand, the latter being designed to be accommodated inside the flask in company with such other means as may be necessary to complete the shielding and cooling functions of the unit. Taking for granted that several fuel elements are to be carried simultaneously in the transport container, an important purpose of the inner container is to maintain the relative positioning of the elements inside the flask which constitutes an outer envelope. The term "bottle" applied to the inner container connotes a containing structure which is fully sealable, a feature which is especially desirable if there is any liklihood that the fuel elements to be transported will leak or otherwise give rise to a release of fission products into the immediate surroundings. The bottle then constitutes an inner, second envelope but except where specified to the contrary no limitation as to sealability is to be inferred from the references made herein to "inner container".

The transport container as a whole must cater not only for safety in transit but also for safe loading and unloading. As regards unloading, the usual practice is to submerge the complete container in a pond of water and to undertake the opening of the container and the withdrawal of the fuel elements under submerged conditions. The purpose of the pond in this connection is mainly to afford transparent shielding for the operatives, a purpose which would be frustrated if the pond were to become heavily contaminated. Bearing in mind that fuel elements discharged from a nuclear reactor may carry adherent extraneous solid matter, an example of which is the so-called "crud" occurring in reactors cooled by water, steps are desirable for ensuring the removal of such solid matter before exposure of the fuel elements to the pond water. To this end the medium in which the elements have travelled, usually water or possibly some other liquid, is removed in separation from the pond water and with this removed liquid may be entrained some of the solid matter. For completing removal of the solid matter a flushing liquid may be introduced and one of the objects of the invention is to facilitate reliable and expeditious performance of the flushing operation.

SUMMARY OF THE INVENTION

For this purpose the invention provides an inner container for use inside a transport flask for irradiated nuclear reactor fuel elements, which inner container comprises a generally cylindrical shell having a dished closure at one end and a detachable lid at the other end, a partitioning structure defining compartments in the shell each for receiving an elongate nuclear reactor fuel element disposed with axis parallel to the axis of the shell, and sealable ducts extending through the lid arranged for injecting streams of flushing liquid from the lid along the axis of each compartment to the dished closure, the dished closure having a drainage sump and ducts arranged for discharging matter from the sump through said other end of the inner container.

The invention provides that after withdrawal of the medium in which the elements have travelled, each of the fuel elements can be flushed down by injection of liquid streams through the lid to remove adherent extraneous solid matter, the solid matter being deposited in the sump and subsequently removed from the inner container by entrainment with flushing liquid and by way of the discharge ducts.

To facilitate deposition of the solid matter in the sump and subsequent discharge therefrom a supplementary supply of flushing liquid may be provided. This supplementary supply may comprise pipes extending from the lidded end of the inner container and arranged to discharge streams of flushing liquid over the dished surface of the end closure. Preferably, the pipes are angularly formed to discharge spiral streams of flushing liquid over the dished surface thereby to impart a swirling component to the streams for scouring the surface of the closure.

After completing the flushing operation of the inner container the lid may be removed for discharge of the fuel elements and, because of prior removal of most of the solid matter, there is little resultant contamination of the pond water. However, it is advisable to seek to prevent the outer surfaces of a flask being contaminated by pond water and accordingly further invention is seen to reside in a method of unloading irradiated nuclear reactor fuel elements from a transport flask having a removable end closure and an inner container in accordance with the invention, the method including the step of sealably shrouding some external surfaces of the flask with flexible sheet material before submerging the flask in a pool of liquid thereby to exclude liquid from contact with the shrouded external surfaces.

DESCRIPTION OF THE DRAWINGS

The invention will be further described, by way of example, with reference to the accompanying drawings wherein.

DESCRIPTION OF THE PREFERRED EMBODIMENTS

Figure 1:
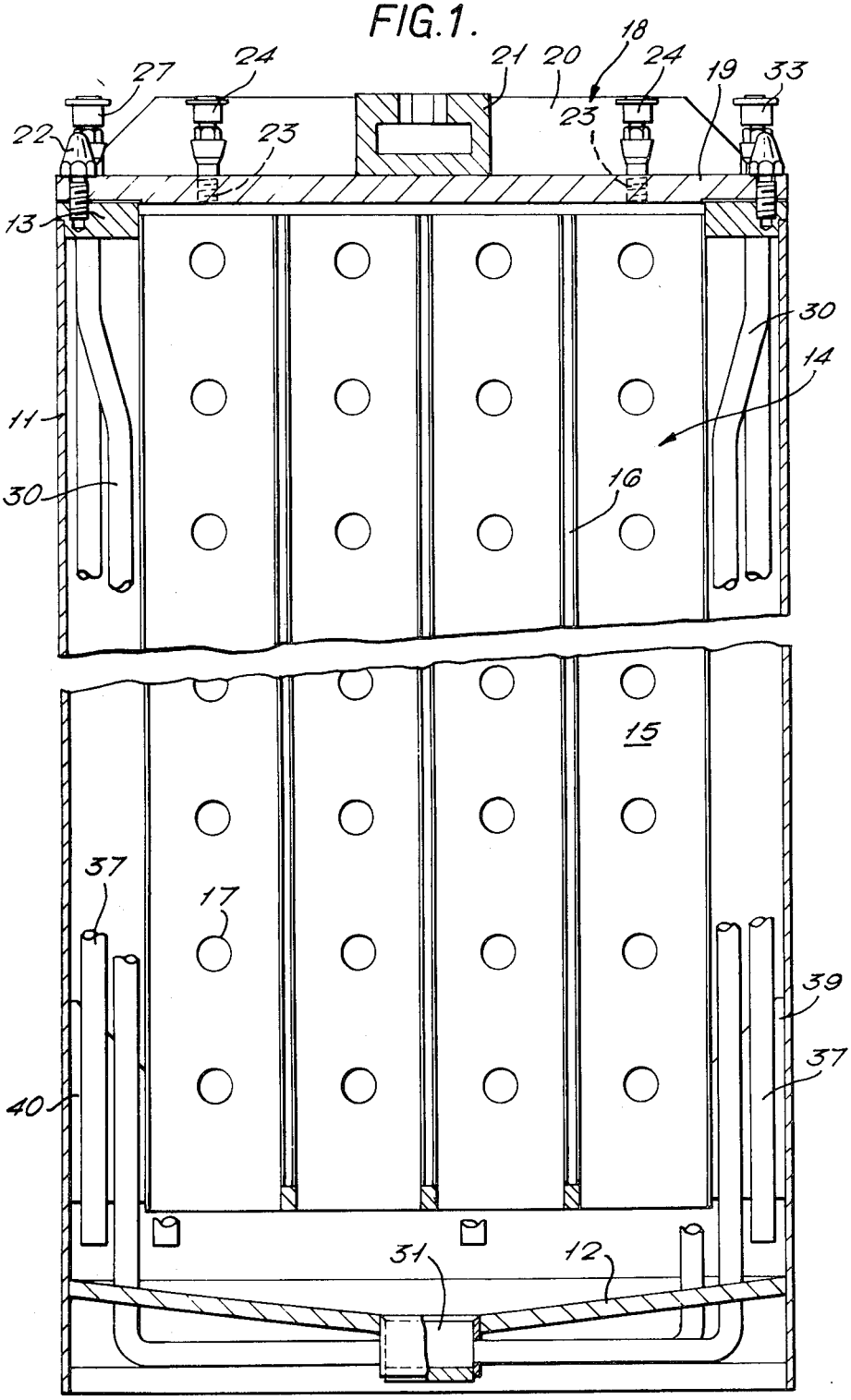
FIG. 1 is a fragmentary longitudinal section of an inner container for use inside an irradiated fuel transport flask.
Figure 2:
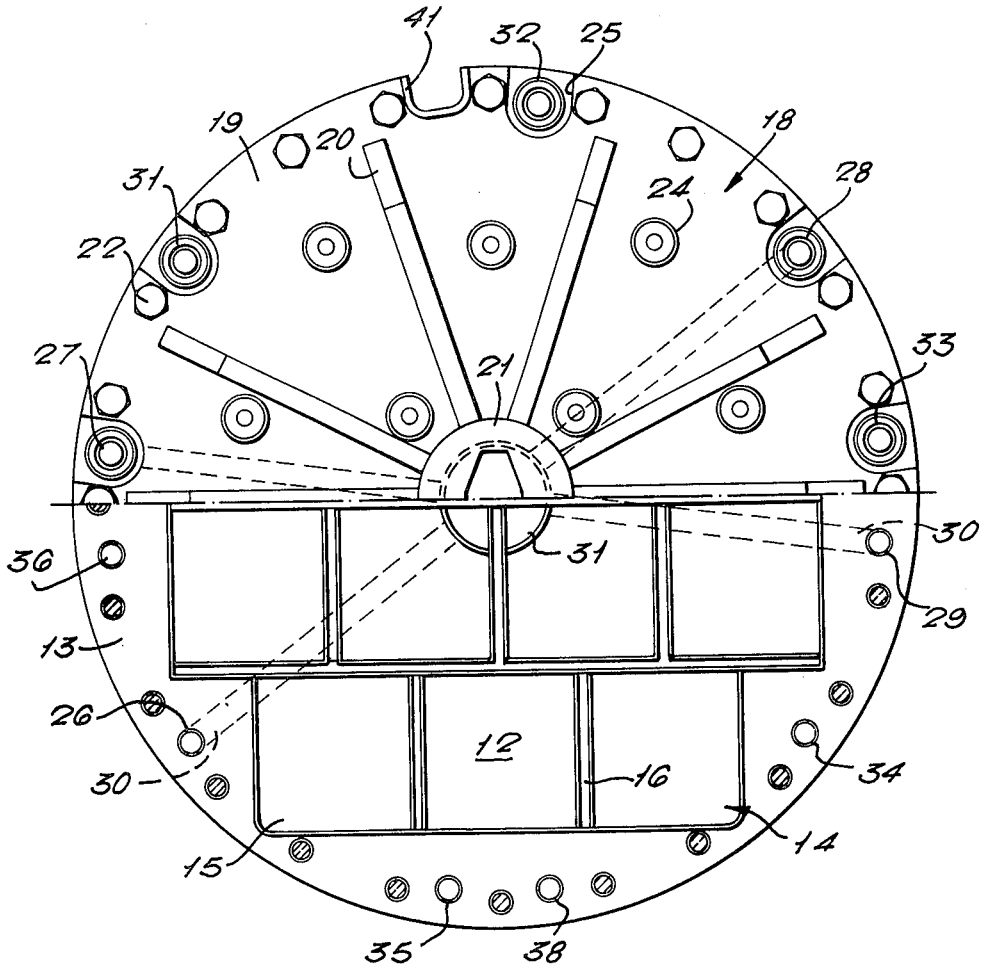
FIG. 2 is a plan view in which the top half shows the closure in position, the lower half being without it.

As seen in FIG. 1 the inner container is basically a cylindrical shell 11 having a dished closure at its bottom end the closure forming a shallow frusto-conical floor 12 and having at its upper end an inwardly projecting flange 13. The inner perimeter of the flange conforms with the outline of an open-ended crate structure of partitions indicated generally 14 which defines, in the case of the present example, fourteen square shaped compartments, such as 15, each for the reception of a correspondingly shaped nuclear reactor fuel element. The metal plates of which the partitioning is formed leave interspaces, such as 16, between neighbouring compartments in order to accommodate neutron poison material, such as that commonly known as Boral, for ensuring nuclear sub-criticality in transit. The partitioning is furthermore perforated at frequent intervals as indicated at 17 in order to allow free passage around the fuel elements of a water filling which is used in conjunction with the fuel elements to act as a heat transfer medium.

The closure for the upper open end of the inner container takes the form of a lid designated generally 18, this lid comprising a generally flat plate 19, radial stiffening ribs 20 and a central lifting boss 21. The lid is secured detachably to the flange 13 by a ring of bolts 22 and with the assistance of a gasket at the mating faces is able to establish a seal such that, in this example, the inner container serves as a "bottle".

The flat plate 19 of the lid is penetrated by a series of flushing liquid inlet ducts, such as is indicated at 23 (FIG. 1) and each of these ducts is aligned centrally relative to the respective fuel element compartments 15 and is fitted with a self-sealing pipe coupling 24 which enables connection to be established easily and detachably with a pipe applied externally to the coupling. Similar couplings are situated at varying intervals in an outer margin of the flange 13, the lid 18 having cut-outs 25 so as to permit access to the couplings upstanding from the flange. The couplings at the four points 26, 27, 28 and 29 are permanently connected by means of respective pipes, such as 30, to a drainage sump 42 situated centrally in the floor 12, these pipes extending inside the container within the vacant interspace between the partitioning structure and the cylindrical side wall and penetrating the floor 12 in a sealed manner in order to reach the sump 42 in radial directions. The couplings at the six points 31, 32, 33, 34, 35 and 36 are in permanent communication with similarly situated pipes, such as 37, but these pipes terminate in open ends somewhat short of the floor 12 with the result that this ring of fairly regulated spaced couplings provides the facility for injecting additional flushing liquid to that introduced through the lid couplings 24.

The last pipe coupling in the flange, as indicated by 38, is for determination of the water filling level, or put in another way, for determination of the amount of free space or ullage left in the container to accommodate thermal expansion effects. To this end a pipe (not shown) with which this particular fitting communicates extends in a similar manner to those previously mentioned but only to a limited depth in the container, for example a depth of about 0.6 m. It is brought into operation by introducing air under pressure over the surface of a full charge of water inside the container when it has been sealed and causing the air to expel water through the coupling 38 until the arrival of air in the effluent becomes apparent. At this stage the correct water level has been determined and the air supply is removed from the coupling 38. Bearing in mind that the container is likely to be of substantial length, about 5 m is typical, pipe brackets (not visible in the drawings) and location plates, such as 39 and 40, are necessary in the interspace between the partitioning structure and the cylindrical side wall in order to establish adequate structural rigidity.

An illustration of the type of transport flask in which the inner container is intended to be accommodated appears on page 504 of the issue of "Nuclear Engineering International" for June 1969, this being a flask of well known design which is used extensively. A channel 41 formed in the lid, and correspondingly running along the length of the inner container, co-operates with an internally projecting key in the flask in order to ensure correct relative orientation of the inner container inside the flask. When a transport flask arrives at a discharge station with a charge of irradiated nuclear fuel elements and has been submerged in a water pond, its end closure is removed and the first step in the sequence of operations on the inner container itself is to expel the water content which has travelled with the fuel. The expulsion of this water is carried out by connection to one of the inlet pipe couplings, ie those indicated 24 or 31–36, of an air inlet pipe for injecting air at a sufficient pressure to force out the water through the drainage well 31 to one or more of the outlet pipe couplings 26–29 depending on how many have also had pipe connections made to them. The next step, maintaining the outlet pipe connections intact, is to start the flushing sequence: each flushing point may be taken in turn in a predetermined order or they may be taken in groups or even simultaneously all at once, it being necessary for each flushing point being used that a pipe connection is simply made to the appropriate pipe coupling and is then detached when flushing from this point is completed.

It will generally be the case that the flange flushing points 31–36 are put into use subsequent to flushing from the points 24 since the former discharge over the extremities of the floor 12 and are therefore effective to apply a scouring action to solid matter which has settled on the floor as a result of dislodgement from the fuel elements. The flushing pipes 37 may be angularly formed to effect discharge of spiral streams of flushing liquid over the dished surface thereby to impart a swirling component to the streams for scouring the floor. Nozzles or other devices for shaping and/or directing jet streams of flushing liquid over the floor may be fitted as necessary to the inlet pipe ends.

A feature of the invention, also relevant to safe unloading, concerns protection of the flask exterior from pond contamination, the possibility that some contamination may occur being one which should not be ignored. According to this feature, the operation of unloading of irradiated nuclear fuel elements from a transport flask under submerged conditions includes the step, before submergence, of shrouding with flexible sheet material substantially all parts of the flask exterior other than those required to be accessible whilst the flask is submerged, the shrouded parts being thereby excluded from direct exposure to the liquid in which submergence takes place. Much of the surface which is shrouded in this way is likely to be finned for cooling purposes, as in the design to which reference is made above, and by being kept dry the extent of cleaning which the flask will require after removal from the pond will be greatly reduced.

The parts which must remain accessible are principally, and possibly exclusively, the end closure of the flask and the fittings to secure the end closure in place. For shrouding the flask it may conveniently be introduced into a bag of the flexible sheet material, the edges of the bag at its open end being clamped in liquid-tight manner by a temporary strap or ligament engirdling the flask as closely adjacent to the end closure as is feasible. If the hold on the flask for the purpose of handling, such as lowering and lifting into and out of the pond, cannot be satisfactorily made with the sheet material as an intermediary, certain additional parts may also need to be left uncovered. Parts of this kind may be projections from the flask wall, for example trunnions, which are fitted for co-operation with cranage gear. In this case the bag of flexible sheet material would have suitably positioned and sized apertures through which the flask projections can protrude, the edges bounding these apertures being clamped temporarily as before by means of a strap or ligament. Sheet material made from plastics will be suitable, given that the quality and thickness is adequate for stretching without rupture over surfaces which are discontinuous and typically finned. An example is nylon reinforced polyvinyl chloride.

For quicker turn round of the flask, this being a substantial item of equipment, separation from the inner container may be undertaken at an early stage following submergence in the pond. A stand is necessary for supporting the inner container in the proper upright attitude. Once the inner container has been withdrawn from the flask to the stand, all the time submerged in the pond, the flask is freed for further travelling.

I claim:

1. An inner container for use inside a transport flask for irradiated nuclear fuel elements, the inner container comprising:

a generally cylindrical shell having a dished closure with a drainage sump at one end, a detachable lid at the other end, a partitioning structure defining compartments in the shell each for receiving an elongate nuclear reactor fuel element disposed with axis parallel to the axis of the shell, and sealable ducts extending through the lid arranged for injecting streams of flushing liquid through the inner container, at least one of the ducts being arranged for discharging matter from the sump through the lid of the inner container.

2. An inner container according to claim 1 wherein the lid of the container carries flushing pipes having open ends arranged for discharging streams of flushing liquid over the dished surface of the integral end closure.

3. An inner container according to claim 2 wherein the open end flushing pipes are angularly formed to effect discharge of spiral streams of flushing liquid over the dished surface thereby to impart a swirling component to the streams for scouring the dished surface of the closure.

4. An inner container according to claim 3 wherein the flushing ducts are arranged to discharge jet streams of flushing liquid through nozzles and along the longitudinal axes of the compartments.

* * * * *